US010356508B2

(12) United States Patent
Hayashida et al.

(10) Patent No.: US 10,356,508 B2
(45) Date of Patent: Jul. 16, 2019

(54) SOUND COLLECTING APPARATUS

(71) Applicant: Panasonic Intellectual Property Corporation of America, Torrance, CA (US)

(72) Inventors: Kohhei Hayashida, Kyoto (JP); Tsuyoki Nishikawa, Osaka (JP); Takeo Kanamori, Osaka (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days.

(21) Appl. No.: 16/000,876

(22) Filed: Jun. 5, 2018

(65) Prior Publication Data

US 2018/0376239 A1 Dec. 27, 2018

(30) Foreign Application Priority Data

Jun. 27, 2017 (JP) ..... 2017-124815

(51) Int. Cl.
*H04R 3/00* (2006.01)
*H04R 5/00* (2006.01)
(Continued)

(52) U.S. Cl.
CPC ..... *H04R 1/222* (2013.01); *H04R 1/245* (2013.01); *H04R 1/406* (2013.01); *H04R 3/005* (2013.01);
(Continued)

(58) Field of Classification Search
CPC .... H04R 1/222; H04R 1/245; H04R 2203/12; H04R 3/005; H04R 3/00; H04S 7/303
(Continued)

(56) References Cited

U.S. PATENT DOCUMENTS

2008/0159559 A1* 7/2008 Akagi ..... H04R 3/00 381/92
2012/0051548 A1 3/2012 Visser et al.
(Continued)

FOREIGN PATENT DOCUMENTS

WO 2009/009568 A2 1/2009

OTHER PUBLICATIONS

Lloyd J. Griffiths et al., "An Alternative Approach to Linearly Constrained Adaptive Beamforming", IEEE Transactions on Antennas and Propagation, vol. AP-30, No. 1, Jan. 1982, pp. 27-34.
(Continued)

*Primary Examiner* — Paul Kim
*Assistant Examiner* — Ubachukwu A Odunukwe
(74) *Attorney, Agent, or Firm* — Greenblum & Bernstein, P.L.C.

(57) ABSTRACT

A sound collecting apparatus capable of effectively suppressing sounds other than a target sound is provided. The sound collecting apparatus includes a plurality of microphones. A total number of effective microphone pairs in which a distance between two microphones is smaller than a distance D is larger than a total number of the plurality of microphones. The distance D is represented by D=c/2f, where the frequency of the target sound acquired from each of the plurality of microphones is f and sound velocity is c. When an angle formed by a straight line connecting two microphones configuring an effective microphone pair and a predetermined straight line is θ, the angles θ of all effective microphone pairs acquired from the plurality of microphones are different from each other.

6 Claims, 8 Drawing Sheets

(51) Int. Cl.
*H04R 1/22* (2006.01)
*H04R 1/24* (2006.01)
*H04R 1/40* (2006.01)

(52) U.S. Cl.
CPC .. *H04R 2201/401* (2013.01); *H04R 2201/405* (2013.01); *H04R 2203/12* (2013.01)

(58) Field of Classification Search
USPC ..... 381/26, 92
See application file for complete search history.

(56) References Cited

U.S. PATENT DOCUMENTS

2013/0343549 A1 12/2013 Vemireddy et al.
2018/0146319 A1* 5/2018 Benattar ..... H04S 7/303 381/26

OTHER PUBLICATIONS

Extended European Search Report, dated Oct. 2, 2018, by the European Patent Office (EPO) for the related European Patent Application No. 18176758.3.

* cited by examiner

SOUND COLLECTING APPARATUS

BACKGROUND

1. Technical Field

The present disclosure relates to a sound collecting apparatus for beam forming.

2. Description of the Related Art

Beamforming is a technique of generating a signal with a sound emphasized in a target sound direction by using voice signals acquired from a plurality of microphone elements. As one example of a beam former using an adaptive filter, a generalized sidelobe canceller is disclosed in L. Griffiths and C. W. Jim, "An alternative approach to linearly constrained adaptive beamforming", IEEE Trans. Antennas Propagation, vol. AP-30, pp. 27-34, January 1982.

SUMMARY

One non-limiting and exemplary embodiment provides a sound collecting apparatus capable of effectively suppressing sounds other than a target sound.

In one general aspect, the techniques disclosed here feature a sound collecting apparatus including a plurality of microphone elements, in which among a plurality of microphone pairs each configured of any two microphone elements included in the plurality of microphone elements, a total number of a plurality of effective microphone pairs in which a distance between the two microphone elements is smaller than a distance D is larger than a total number of the plurality of microphone elements, the distance D is represented by D=c/2f, where a frequency of a target sound acquired from the plurality of microphone elements is f and sound velocity is c, and when an angle formed by a straight line connecting two microphone elements configuring each of the plurality of effective microphone pairs and a predetermined straight line is θ, the angles θ of all of the plurality of effective microphone pairs acquired from the plurality of microphone elements are varied.

The sound collecting apparatus of the present disclosure can effectively suppress sounds other than a target sound.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
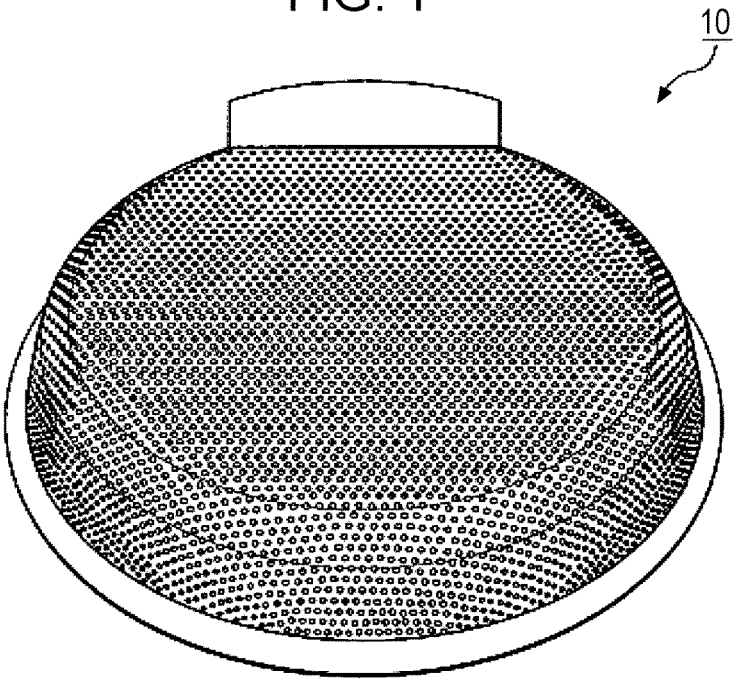
FIG. 1 is an external perspective view of a sound collecting apparatus according to one embodiment.

In the following, embodiments are described with reference to the drawings. The embodiments described below represent general or specific examples. Numerical values, shapes, materials, components, arrangement and connection modes of the components, and so forth described in the following embodiments are merely examples, and are not meant to restrict the present disclosure. Also, among the components in the following embodiments, a component not described in an independent claim representing a broadest concept is described as an optional component.

Furthermore, each drawing is merely a schematic drawing, and is not strictly depicted. Still further, in each drawing, components having a substantially same function are provided with the same reference character, and redundant description may be omitted or simplified.

Still further, in the following embodiments, when the sound collecting apparatus takes a sound coming from one direction as a main output target, that direction is represented as a target sound direction and that sound is represented as a target sound. Still further, sounds other than the target sound may be represented as noise.

EMBODIMENTS

[General Outline of Sound Collecting Apparatus]

Figure 2:
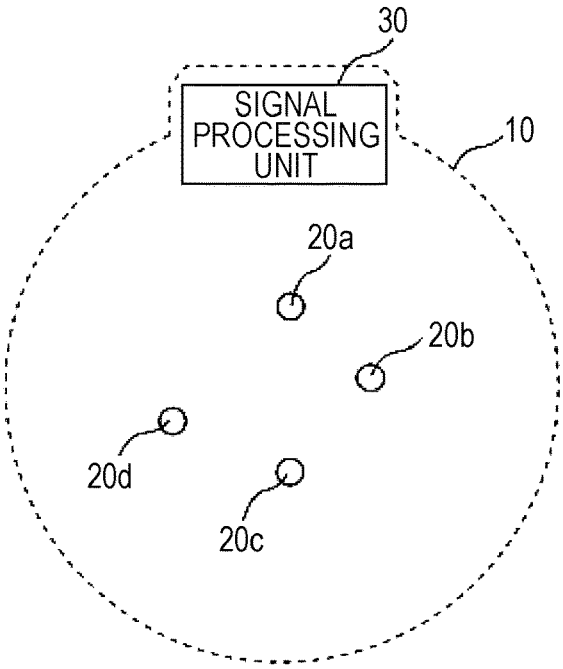
FIG. 2 is a schematic diagram of one example of an inner structure of the sound collecting apparatus according to the present embodiment.

In the following, a general outline of the sound collecting apparatus according to one embodiment is described by using FIG. 1 and FIG. 2. FIG. 1 is an external perspective view of the sound collecting apparatus according to the present embodiment. FIG. 2 is a schematic diagram of one example of an inner structure of the sound collecting apparatus according to the present embodiment.

As depicted in FIG. 1, a sound collecting apparatus 10 according to the present embodiment is a substantially disk-shaped apparatus. The sound collecting apparatus 10 is placed, for example, on a desk to acquire voice in a telephone conference or the like. As depicted in FIG. 2, the sound collecting apparatus 10 includes a plurality of microphone elements 20*a* to 20*d* and a signal processing unit 30. Note that the shape of the sound collecting apparatus 10 is not limited to a substantially disk shape.

The signal processing unit 30 performs beamforming by using a voice signal acquired from each of the plurality of microphone elements 20*a* to 20*d*. Beamforming of the signal processing unit 30 is a signal process of forming directivity so that noise is at a dead angle while sensitivity in the target sound direction is ensured. That is, according to beamforming of the signal processing unit 30, noise coming from directions other than the target sound direction is suppressed. While each of the plurality of microphone elements 20*a* to 20*d* is a non-directional microphone element, the sound collecting apparatus 10 has high sensitivity in the target sound direction by beamforming of the signal processing unit 30.

[Functional Structure of Sound Collecting Apparatus]

Figure 3:
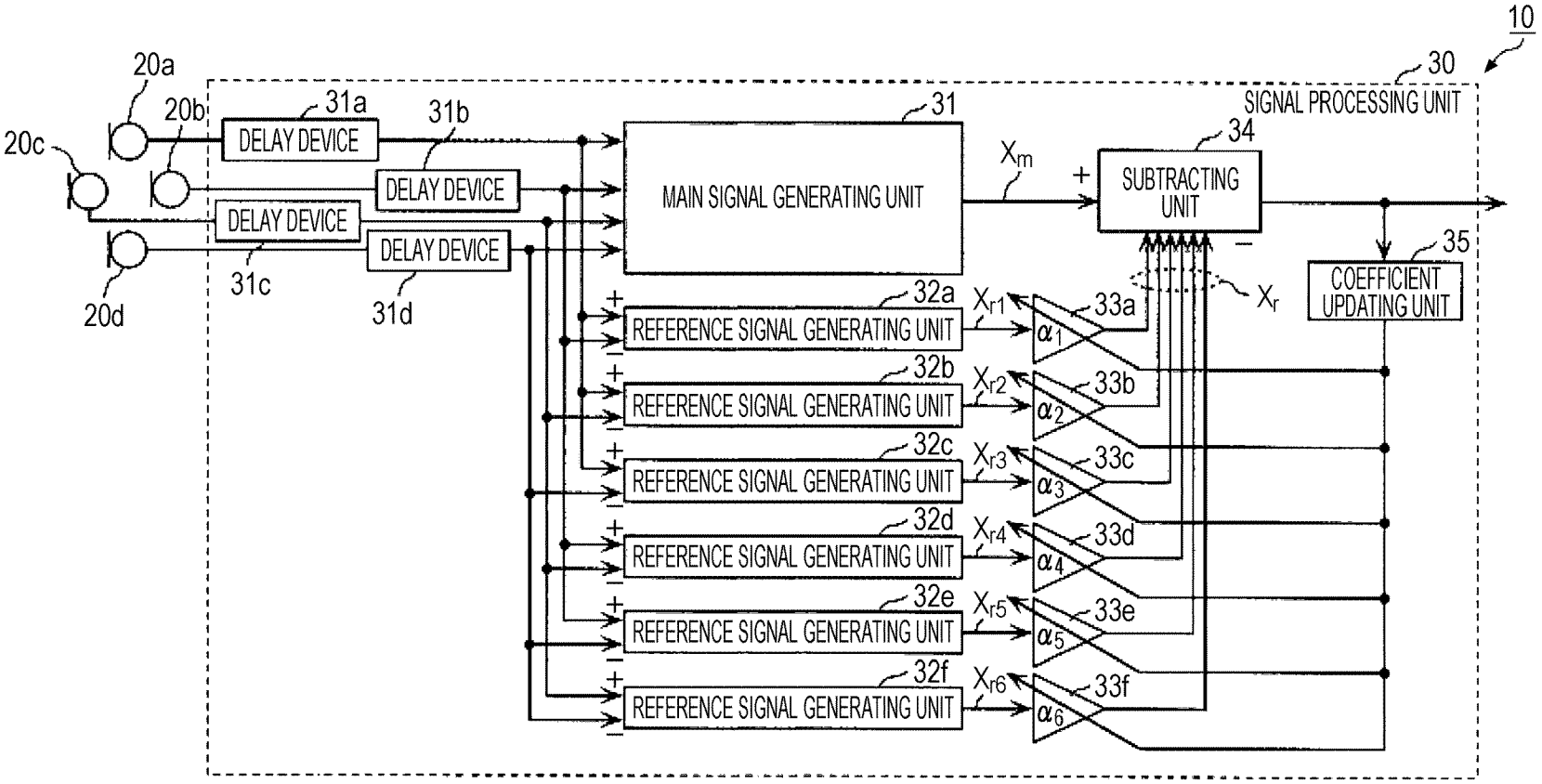
FIG. 3 is a block diagram of a functional structure of the sound collecting apparatus according to the present embodiment.

Next, a functional structure of the sound collecting apparatus 10 is described. FIG. 3 is a block diagram of the functional structure of the sound collecting apparatus 10 according to the present embodiment. As depicted in FIG. 3, the sound collecting apparatus 10 includes the plurality of microphone elements 20*a* to 20*d* and the signal processing unit 30. Note that the sound collecting apparatus does not have to include the signal processing unit 30 and the signal processing unit 30 may be achieved as an apparatus different from the sound collecting apparatus 10.

The plurality of microphone elements 20*a* to 20*d* are a microphone array for generating a main signal $X_m$ and reference signals $X_{r1}$ to $X_{r6}$ for use in beamforming. In other words, the plurality of microphone elements 20*a* to 20*d* are used for the signal processing unit 30 as a beamformer to acquire a voice signal. The plurality of microphone elements 20*a* to 20*d* are arranged on the same plane. In the present embodiment, the sound collecting apparatus 10 includes four microphone elements 20*a* to 20*d*, but a total number of microphone elements is not particularly limited. The total number of microphone elements may be an even number or an odd number. The sound collecting apparatus 10 may include, for example, four or more microphone elements.

The signal processing unit 30 is a beamformer. More specifically, the signal processing unit 30 has a structure similar to that of a generalized sidelobe canceller. The signal processing unit 30 is achieved by a processor, for example, such as a digital signal processor (DSP), but may be achieved by a microcomputer or circuit. Also, the signal processing unit 30 may be achieved by a combination of two or more of a processor, a microcomputer, and a circuit. The signal processing unit 30 includes delay devices 31*a* to 31*d*, a main signal generating unit 31, reference signal generating units 32*a* to 32*f*, adaptive filter units 33*a* to 33*f*, a subtracting unit 34, and a coefficient updating unit 35.

The delay devices 31*a* to 31*d* correspond to voice signals acquired from the plurality of microphone elements 20*a* to 20*d* in a one-to-one relation. The delay devices 31*a* to 31*d* give the voice signals acquired from the plurality of microphone elements 20*a* to 20*d*, respectively, a delay in accordance with the target sound direction, and output the resultant signal as an output signal.

The main signal generating unit 31 is one example of a first signal generating unit, generating a main signal $X_m$ by adding the voice signals acquired from the plurality of microphone elements 20*a* to 20*d* and given, by the delay devices 31*a* to 31*d*, the delay in accordance with the target sound direction. The main signal $X_m$ is one example of a first signal.

The reference signal generating units 32*a* to 32*f* are one example of a second signal generating unit. The reference signal generating units 32*a* to 32*f* correspond to six microphone pairs each configured of any two microphone elements included in the plurality of microphone elements 20*a* to 20*d* in a one-to-one relation. One reference signal generating unit generates a reference signal by performing subtraction on the voice signals acquired from the microphone elements configuring one microphone pair and given, by the delay devices 31*a* to 31*d*, the delay in accordance with the target sound direction. Each of the reference signals $X_{r1}$ to $X_{r6}$ is one example of a second signal.

Also, the adaptive filter units 33*a* to 33*f* correspond to the reference signal generating units 32*a* to 32*f* in one-to-one relation. The adaptive filter units 33*a* to 33*f* applies filter coefficients $\alpha_1$ to $\alpha_6$ to the corresponding reference signal generating units 32*a* to 32*f*.

For example, the reference signal generating unit 32*a* generates a reference signal $X_{r1}$ by performing subtraction on voice signals acquired from the microphone elements 20*a* and 20*b*, respectively, and given, by the delay devices 31*a* and 31*b*, the delay in accordance with the target sound direction (output signals from the delay devices 31*a* and 31*b*). The adaptive filter unit 33*a* applies the filter coefficient $\alpha_1$ to the reference signal $X_{r1}$.

Similarly, the reference signal generating unit 32*b* generates a reference signal $X_{r2}$ by performing subtraction on voice signals acquired from the microphone elements 20*a* and 20*c*, respectively, and given, by the delay devices 31*a* and 31*c*, the delay in accordance with the target sound direction (output signals from the delay devices 31*a* and 31*c*). The adaptive filter unit 33*b* applies the filter coefficient $\alpha_2$ to the reference signal $X_{r2}$.

The reference signal generating unit 32*c* generates a reference signal $X_{r3}$ by performing subtraction on voice signals acquired from the microphone elements 20*a* and 20*d*, respectively, and given, by the delay devices 31*a* and 31*d*, the delay in accordance with the target sound direction (output signals from the delay devices 31*a* and 31*d*). The adaptive filter unit 33*c* applies the filter coefficient $\alpha_3$ to the reference signal $X_{r3}$.

The reference signal generating unit 32*d* generates a reference signal $X_{r4}$ by performing subtraction on voice signals acquired from the microphone elements 20*b* and 20*c*, respectively, and given, by the delay devices 31*b* and 31*c*, the delay in accordance with the target sound direction (output signals from the delay devices 31*b* and 31*c*). The adaptive filter unit 33*d* applies the filter coefficient $\alpha_4$ to the reference signal $X_{r4}$.

The reference signal generating unit 32*e* generates a reference signal $X_{r5}$ by performing subtraction on voice signals acquired from the microphone elements 20*b* and 20*d*, respectively, and given, by the delay devices 31*b* and 31*d*, the delay in accordance with the target sound direction (output signals from the delay devices 31*b* and 31*d*). The adaptive filter unit 33*e* applies the filter coefficient $\alpha_5$ to the reference signal $X_{r5}$.

The reference signal generating unit 32*f* generates a reference signal $X_{r6}$ by performing subtraction on voice signals acquired from the microphone elements 20*c* and 20*d*, respectively, and given, by the delay devices 31*c* and 31*d*, the delay in accordance with the target sound direction (output signals from the delay devices 31*c* and 31*d*). The adaptive filter unit 33*f* applies the filter coefficient $\alpha_6$ to the reference signal $X_{r6}$.

The subtracting unit 34 subtracts the reference signals $X_{r1}$ to $X_{r6}$ applied with the filter coefficients $\alpha_1$ to $\alpha_6$ from the generated main signal $X_m$. An output signal Y, which is a signal acquired as a result of subtraction, is represented by the following Equation 1. The output signal Y is one example of a third signal. In Equation 1, n is the number of microphone pairs. That is, n is a natural number, and n=6 holds in the sound collecting apparatus 10.

$$Y = X_m - \sum_{k=1}^{n} \alpha_k X_{rk} \tag{1}$$

The coefficient updating unit 35 updates the filter coefficients $\alpha_1$ to $\alpha_6$ based on the output signal Y acquired by subtraction of the subtracting unit 34.

Figure 4:
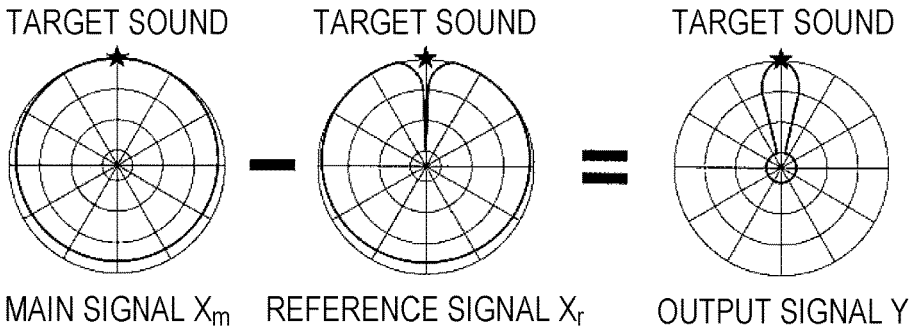
FIG. 4 is a diagram schematically depicting an equation for calculation of an output signal by using sensitivity characteristics of a main signal, a reference signal, and the output signal.

FIG. 4 is a diagram schematically depicting Equation 1 by sensitivity characteristics of the main signal $X_m$, a reference signal $X_r$, and the output signal Y. Note that the reference signal $X_r$ refers to a total of the reference signals $X_{r1}$ to $X_{r6}$ applied with the filter coefficients $\alpha_1$ to $\alpha_6$ ($\alpha_1X_{r1}+\alpha_2X_{r2}+\alpha_3X_{r3}+\alpha_4X_{r4}+\alpha_6X_6+\alpha_6X_{r6}$). The sensitivity characteristics represent, in other words, directivity.

As depicted in FIG. 4, the main signal $X_m$ has high sensitivity in all directions. By contrast, the reference signal $X_r$ has low sensitivity in the target sound direction due to the adaptive filter units 33*a* to 33*f* and the coefficient updating unit 35. Therefore, the output signal Y acquired by subtracting the reference signal $X_r$ from the main signal $X_m$ has high sensitivity in the target sound direction. Note that the target sound direction is, in other words, a beam direction.

[Arrangement of Plurality of Microphone Elements]

In the sound collecting apparatus 10, the signal processing unit 30 can change the beam direction in the output signal Y. For example, the sound collecting apparatus 10 includes a user interface such as a touch panel or operation button, and the signal processing unit 30 changes the beam direction based on user operation accepted through the user interface. Alternatively, the signal processing unit 30 automatically changes the beam direction by detecting a sound volume or the like.

In this manner, when the signal processing unit 30 performs beamforming with a variable beam direction, sensitivity in the output signal Y in directions other than any beam direction has to be reduced as much as possible. To ensure this performance, the arrangement of the plurality of microphone elements 20*a* to 20*d* is defined in the sound collecting apparatus 10.

In the sound collecting apparatus 10, the total number of effective microphone pairs is larger than the total number of the plurality of microphone elements 20*a* to 20*d*. Here, effective microphone pairs are among microphone pairs each configured of any two microphone elements included in the plurality of microphone elements 20*a* to 20*d*, in which a distance between two microphone elements is shorter than a distance D. The distance D is represented by D=c/2f, where the frequency of the target sound acquired from the plurality of microphone elements 20*a* to 20*d* is f and sound velocity is c. In the sound collecting apparatus 10, the total number of effective microphone pairs is six, and the total number of the plurality of microphone elements is four.

Note that the distance D varies depending on the frequency of the target sound. For example, when the target sound has a frequency of 8 kHz, the distance D is 2.125 cm if the sound velocity c=34000 cm/s. Also, when the target sound has a frequency of 4 kHz, the distance D is 4.25 cm if the sound velocity c=34000 cm/s.

The reference signal calculated from a non-effective microphone pair in which the distance between the two microphone elements is equal to or longer than the distance D may not have sensitivity characteristics expected from the arrangement of the non-effective microphone pair due to, for example, occurrence of a folding component in signal processing. That is, the reference signal calculated from the non-effective microphone pair may have unexpected sensitivity characteristics, hindering generation of the output signal Y with high accuracy. In the sound collecting apparatus 10, with the total number of effective microphone pairs being larger than the total number of the plurality of microphone elements 20*a* to 20*d*, generation of the output signal Y with high accuracy is achieved.

Note in the sound collecting apparatus 10 that the microphone pairs acquired from the plurality of microphone elements 20*a* to 20*d* are all effective microphone pairs. That is, the total number of microphone pairs acquired from the plurality of microphone elements 20*a* to 20*d* is equal to the total number of effective microphone pairs. However, part of the microphone pairs acquired from the plurality of microphone elements 20*a* to 20*d* may be effective microphone pairs.

Figure 5:
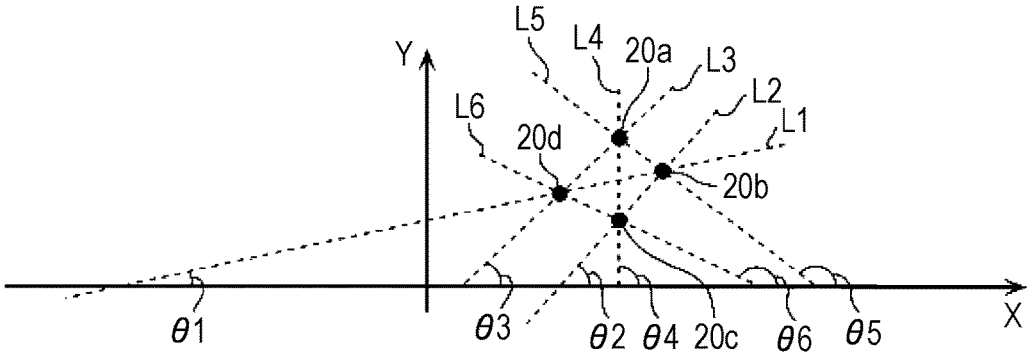
FIG. 5 is a diagram of an arrangement of a plurality of microphone elements in a planar view.

Also, in a planar view when a plane where the plurality of microphone elements 20*a* to 20*d* are arranged is viewed from a direction perpendicular to the plane and an angle formed by a straight line connecting two microphone elements configuring an effective microphone pair and a predetermined straight line is θ, the angles θ of all effective microphone pairs included in the plurality of microphone elements 20*a* to 20*d* are varied. FIG. 5 is a diagram of an arrangement of the plurality of microphone elements 20*a* to 20*d* in the planar view. Note in FIG. 5 that coordinate axes are depicted. In the example of FIG. 5, the predetermined straight line is, for example, the X axis or a straight line parallel to the X axis, but may be the Y axis or a straight line parallel to the Y axis. The predetermined straight line may be a straight line crossing both of the X axis and the Y axis. The predetermined straight line is only required to be defined as any one straight line. When the straight line connecting two microphone elements configuring an effective microphone pair and the predetermined straight line are parallel to each other, θ is 0.

As depicted in FIG. 5, an angle formed by a straight line L1 connecting the microphone elements 20*b* and 20*d* configuring an effective microphone pair and the X axis is θ1. An angle formed by a straight line L2 connecting the microphone elements 20*b* and 20*c* configuring an effective microphone pair and the X axis is θ2, and an angle formed by a straight line L3 connecting the microphone elements 20*a* and 20*d* configuring an effective microphone pair and the X axis is θ3.

Similarly, an angle formed by a straight line L4 connecting the microphone elements 20*a* and 20*c* configuring an effective microphone pair and the X axis is θ4. An angle formed by a straight line L5 connecting the microphone elements 20*a* and 20*b* configuring an effective microphone pair and the X axis is θ5, and an angle formed by a straight line L6 connecting the microphone elements 20*c* and 20*d* configuring an effective microphone pair and the X axis is θ6.

Here, θ1 is different from any of θ2 to θ6, and θ2 is different from any of θ1 and θ3 to θ6. The same goes for θ3 to θ6. Note that what θ is different from the others means that θ defined based on the same reference as that as depicted in FIG. 5 is different from the others. For example, even when θ1 matches 180°-θ6 in FIG. 5, θ1 is judged as different from θ6.

Figure 6:
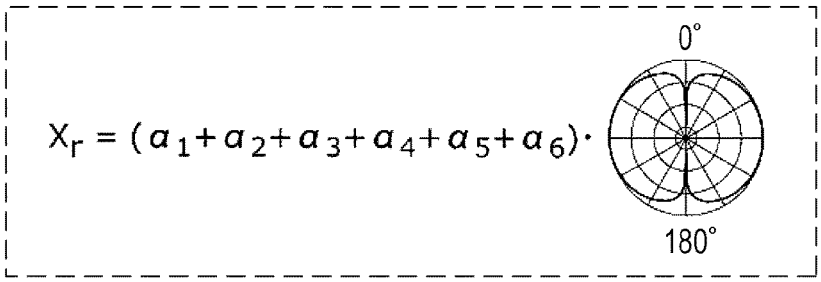
FIG. 6 is a diagram schematically depicting a reference signal $X_r$ when reference signals $X_{r1}$ to $X_{r6}$ generated with a 0° direction taken as a target sound direction have the same sensitivity characteristics.

This difference in θ is a difference in sensitivity characteristics in the reference signal. If all θ1 to θ6 are the same, the reference signals $X_{r1}$ to $X_{r6}$ acquired from six effective microphone pairs have similar sensitivity characteristics. FIG. 6 is a diagram schematically depicting the reference signal $X_r$ when the reference signals $X_{r1}$ to $X_{r6}$ generated with a 0° direction taken as the target sound direction have the same sensitivity characteristics.

As depicted in FIG. 6, when the reference signals $X_{r1}$ to $X_{r6}$ each have low sensitivity (hereinafter also represented as having a dead angle) in the 0° direction and the 180° direction with respect to the target sound direction, the reference signal $X_r$ added with the reference signals $X_{r1}$ to $X_{r6}$ also has a dead angle in the 0° direction and the 180° direction. In this case, in the output signal Y, it is difficult to decrease sensitivity in the 180° direction, that is, suppress noise in the 180° direction.

Figure 7:
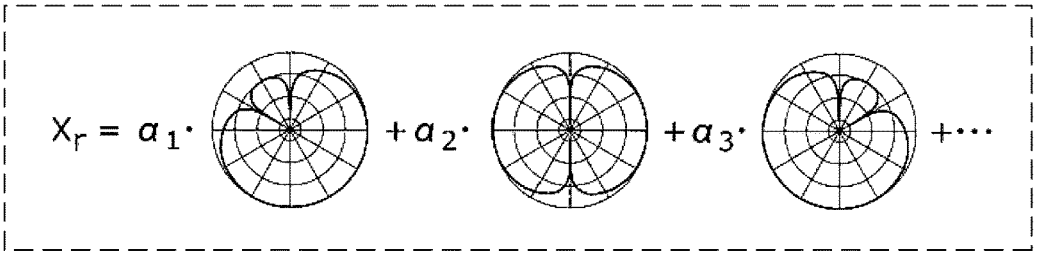
FIG. 7 is a diagram schematically depicting the reference signal $X_r$ when the reference signals $X_{r1}$ to $X_{r6}$ have different sensitivity characteristics.

By contrast, when θ1 to θ6 are all different from one another, the reference signals $X_{r1}$ to $X_{r6}$ acquired from six effective microphone pairs have different sensitivity characteristics. FIG. 7 is a diagram schematically depicting the reference signals $X_r$ when the reference signals $X_{r1}$ to $X_{r6}$ have different sensitivity characteristics.

As depicted in FIG. 7, when θ1 to θ6 are all different from one another, the reference signals $X_{r1}$ to $X_{r6}$ have dead angles in different directions. Thus, the dead angle of one reference signal can be supplemented by another reference signal. That is, directions in which sensitivity is not decreasable in the output signal Y are reduced, and noise in various directions can be suppressed.

As described above, the arrangement of the plurality of microphone elements 20*a* to 20*d* in the sound collecting apparatus 10 is only required to satisfy two requirements. One requirement is that the total number of effective microphone pairs included in the sound collecting apparatus 10 is more than the total number of the plurality of microphone elements 20*a* to 20*d* included in the sound collecting apparatus 10. The other requirement is that the angles θ of all effective microphone pairs included in the sound collecting apparatus 10 are varied.

This allows the sound collecting apparatus 10 to supplement the dead angle of one reference signal by another reference signal. Thus, directions in which sensitivity is not decreasable in the output signal Y are reduced, and noise in various directions can be suppressed. That is, the sound collecting apparatus 10 can effectively suppress sounds other than the target sound. Also, the arrangement of the plurality of microphone elements 20*a* to 20*d* is particularly useful when the sound collecting apparatus 10 can change the target sound direction or is used for a system which can change the target sound direction.

[Evaluation of Arrangement of Plurality of Microphone Elements]

The dead angles of the reference signals $X_{r1}$ to $X_{r6}$ are preferably distributed. Ideally, the dead angles of the reference signals $X_{r1}$ to $X_{r6}$ are preferably equally distributed. To equally distribute the dead angles in the reference signals $X_{r1}$ to $X_{r6}$, θ1 to θ6 are preferably varied by 180°/6=30° in the sound collecting apparatus 10. For example, (θ2, θ3, θ4, θ5, θ6)=(θ1+30°, θ1+60°, θ1+90°, θ1+120°, θ1+150°) is preferable. When the total number of effective microphone pairs is n (n is a natural number), n effective microphone pairs preferably have angles θ varied by 180°/n. This reduces directions in which sensitivity is not decreasable in the output signal Y and can suppress noise in various directions.

Here, as a scheme of evaluating the arrangement of the plurality of microphone elements, an evaluation scheme based on a difference in angles θ between effective microphone pairs is conceivable. Specifically, the effective microphone pairs are sorted in the descending order of the angles θ, and the arrangement of the plurality of microphone elements can be evaluated based on the difference in angles θ between adjacent effective microphone pairs. Here, an evaluation value A is represented by, for example, the following Equation 2. $T_k$ in Equation 2 is represented by Equation 3, and $T_{ideal}$ in Equation 2 is represented by Equation 4.

$$A = \frac{1}{n-1}\sum_{k=1}^{n}|T_{ideal} - T_k| \tag{2}$$

$$T_k = \theta_k - \theta_{k+1} (1 \le k \le n-1) \tag{3}$$

$$T_{ideal} = \frac{180}{n} \tag{4}$$

The evaluation value A is better as being smaller. That is, as the evaluation value A is smaller, directions in which sensitivity is not decreasable in the output signal Y are reduced, and noise in various directions can be suppressed. FIG. 8 to FIG. 11 are diagrams of results of evaluation on the arrangement of the plurality of microphone elements. In FIG. 8 to FIG. 11, the positions of the microphone elements are indicated by dots on the coordinate axes.

Figure 8:
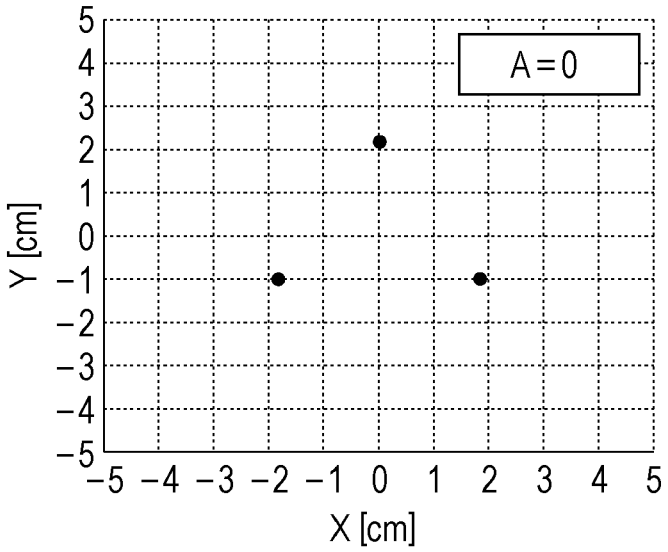
FIG. 8 is a first diagram of results of evaluation on the arrangement of the plurality of microphone elements.
Figure 9:
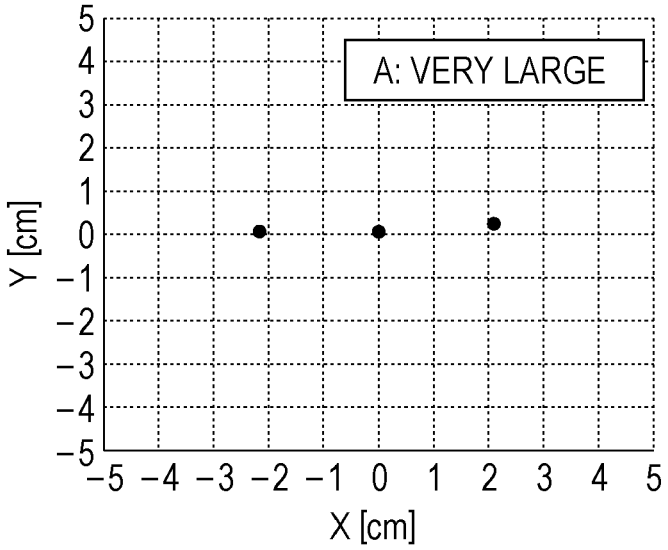
FIG. 9 is a second diagram of results of evaluation on the arrangement of the plurality of microphone elements.

In FIG. 8 and FIG. 9, the total number of the plurality of microphone elements is three. As depicted in FIG. 8, when three microphone elements are arranged at positions corresponding to the vertexes of an equilateral triangle, the evaluation value A is 0. Also as depicted in FIG. 9, when three microphone elements are substantially linearly arranged, the evaluation value A is very large.

Figure 10:
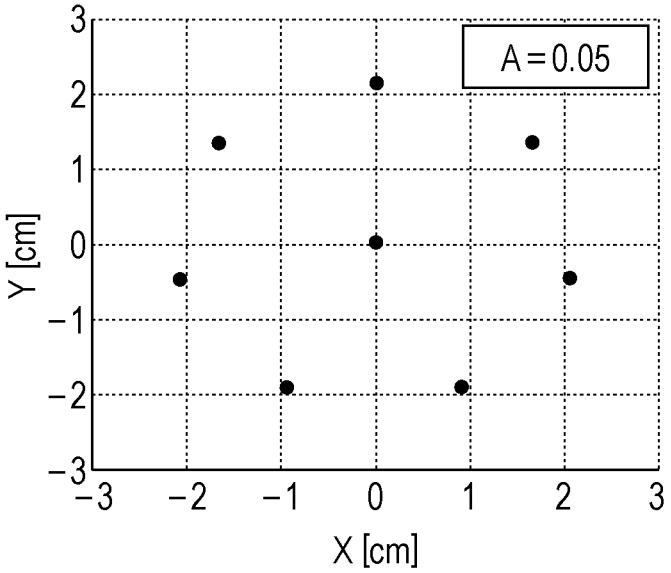
FIG. 10 is a third diagram of results of evaluation on the arrangement of the plurality of microphone elements.
Figure 11:
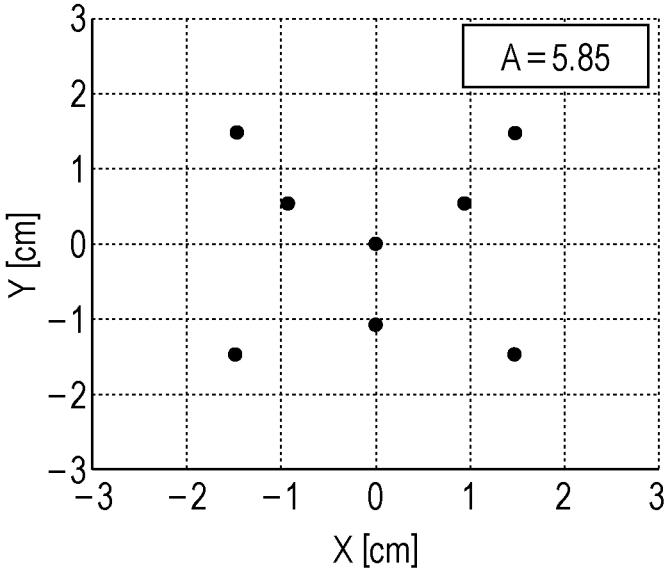
FIG. 11 is a fourth diagram of results of evaluation on the arrangement of the plurality of microphone elements.

Meanwhile, in FIG. 10 and FIG. 11, the total number of the plurality of microphone elements is eight. In the arrangement of FIG. 10, the total number of effective microphone pairs having the angles θ different from those of the other effective microphone pairs is fourteen, and the evaluation value A is 0.05. In the arrangement of FIG. 10, the total number of effective microphone pairs is (the total number of the plurality of microphone elements-1)×2. In the arrangement of FIG. 10, the plurality of microphone elements are arranged at positions corresponding to the vertexes of an equilateral heptagon and the center position (barycentric position) of the equilateral heptagon. In this manner, the plurality of microphone elements may be arranged at positions corresponding to the vertexes of an equilateral N-gon (N is an odd number) and the center position of the equilateral N-gon. Note that the equilateral N-gon does not refer to an equilateral N-gon in a strict sense and is only required to be a substantially equilateral N-gon.

Meanwhile, in the arrangement of FIG. 11, the total number of effective microphone pairs having the angles θ different from those of the other effective microphone pairs is twelve, and the evaluation value A is 5.85. In the arrangement of FIG. 11, the total number of effective microphone pairs is smaller than (the total number of the plurality of microphone elements-1)×2.

As described above, the total number of effective microphone pairs may be equal to or smaller than (the total number of the plurality of microphone elements-1)×2.

[Total Number of Microphone Elements]

Figure 12:
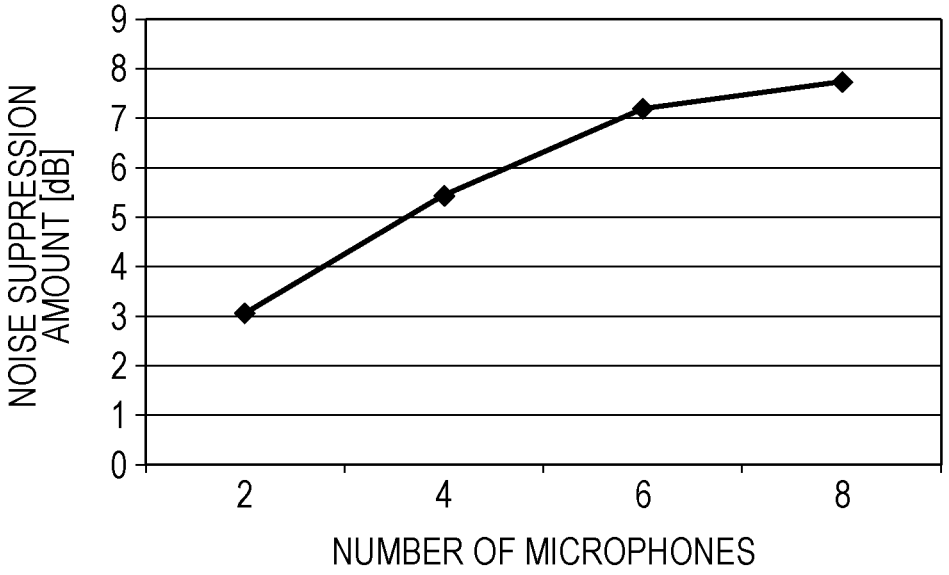
FIG. 12 is a diagram of a relation between a total number of microphone elements and noise suppression amount.

While the sound collecting apparatus 10 includes four microphone elements 20*a* to 20*d*, the total number of microphone elements included in the sound collecting apparatus 10 is not particularly limited. The sound collecting apparatus 10 may include, for example, six or more microphone elements. FIG. 12 is a diagram of a relation between the total number of microphone elements and noise suppression amount. Note that FIG. 12 depicts the noise suppression amount when the microphone elements are equidistantly arranged along the circumference of a circle and signal processing is performed by a generalized sidelobe canceller such as the signal processing unit 30.

As depicted in FIG. 12, as the total number of microphone elements increases, the noise suppression amount increases. Here, when the total number of microphone elements is equal to or more than six, the amount of increase of the noise suppression amount tends to be significantly decreased. Thus, it can be thought that a sufficient noise suppression amount can be acquired if the sound collecting apparatus 10 includes six or more microphone elements.

Note that in the field of acoustic technology, an even number of loudspeakers or microphone elements are often used in a device such as a stereo system. Thus, if the total number of microphone elements included in the sound collecting apparatus 10 is an even number, an effect of easy compatibility with another hardware can be acquired.

[Dead Angle Range of Reference Signal]

Figure 13:
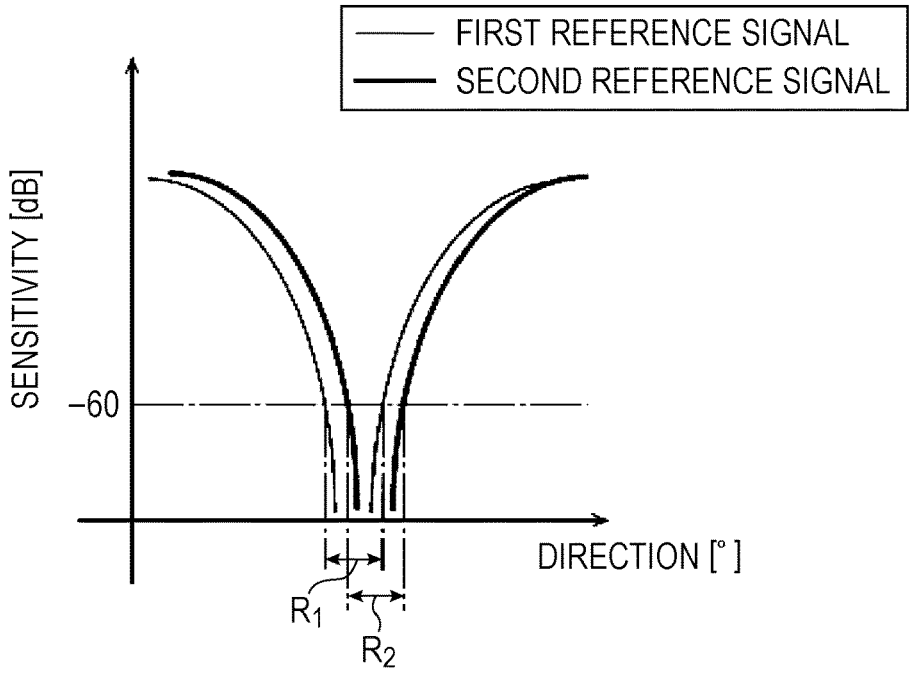
FIG. 13 is a first schematic diagram depicting sensitivity characteristics of a first reference signal acquired from a first effective microphone pair and sensitivity characteristics of a second reference signal acquired from a second effective microphone pair.
Figure 14:
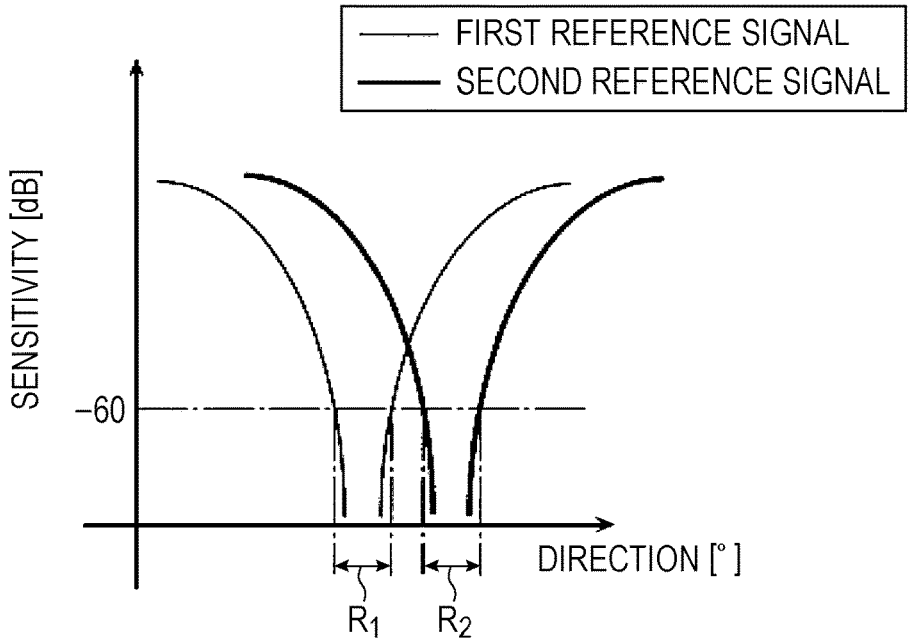
FIG. 14 is a second schematic diagram depicting the sensitivity characteristics of the first reference signal acquired from the first effective microphone pair and the sensitivity characteristics of the second reference signal acquired from the second effective microphone pair.

All effective microphone pairs acquired from the plurality of microphone elements 20*a* to 20*d* may be arranged so that dead angle ranges of the reference signals acquired from the effective microphone pairs do not overlap one another. In the following, the dead angle ranges of the reference signals are described. FIG. 13 and FIG. 14 are schematic diagrams depicting sensitivity characteristics of a first reference signal acquired from a first effective microphone pair and sensitivity characteristics of a second reference signal acquired from a second effective microphone pair. Note that the first effective microphone pair and the second effective microphone pair are effective microphone pair acquired from the plurality of microphone elements 20*a* to 20*d*.

A first dead angle range $R_1$ is, for example, an angle range in which sensitivity is equal to or smaller than −60 dB in the sensitivity characteristics of the first reference signal. A second dead angle range $R_2$ is, for example, an angle range in which sensitivity is equal to or smaller than −60 dB in the sensitivity characteristics of the second reference signal. Note that each dead angle range is in a range in which sensitivity is equal to or smaller than a predetermined value in the sensitivity characteristics of the reference signal and −60 dB is one example of the predetermined value.

Here, FIG. 13 depicts a case when the first dead angle range $R_1$ and the second dead angle range $R_2$ overlap, and FIG. 14 depicts a case when the first dead angle range $R_1$ and the second dead angle range $R_2$ do not overlap. As depicted in FIG. 14, when the first dead angle range $R_1$ and the second dead angle range $R_2$ do not overlap, directions in which sensitivity is not decreasable in the output signal Y are reduced, allowing suppression of noise in various directions.

When the distance between two microphone elements configuring a target microphone pair is 2.125 cm, the dead angle range is in a range of ±0.05° centering at an angle at which sensitivity is minimum. Note that a difference between the angle at which sensitivity is minimum in the sensitivity characteristics of the first reference signal and the angle at which sensitivity is minimum in the sensitivity characteristics of the second reference signal is equal to the difference between the angle θ of the first effective microphone pair and the angle θ of the second effective microphone pair. Therefore, when the first dead angle range $R_1$ and the second dead angle range $R_2$ do not overlap, this means that the angle θ of the first effective microphone pair and the angle θ of the second effective microphone pair are different from each other at least by 0.1° or more.

In this manner, in the sound collecting apparatus 10, all effective microphone pairs acquired from the plurality of microphone elements 20*a* to 20*d* may not have dead angle ranges overlap. The dead angle range is an angle range in which sensitivity in sensitivity characteristics of the second signal acquired from the effective microphone pair has a value equal to or smaller than a predetermined value. This reduces directions in which sensitivity is not decreasable in the output signal Y and allows suppression of noise in various directions.

[Effects and Others]

As has been described in the foregoing, the sound collecting apparatus 10 includes the plurality of microphone elements 20*a* to 20*d*. Among microphone pairs each configured of any two microphone elements included in the plurality of microphone elements 20*a* to 20*d*, the total number of effective microphone pairs in which a distance between the two microphone elements is shorter than the distance D is larger than the total number of the plurality of microphone elements 20*a* to 20*d*.

The distance D is represented by D=c/2f where the frequency of the target sound acquired from the plurality of microphone elements 20*a* to 20*d* is f and sound velocity is c. When an angle formed by a straight line connecting two microphone elements configuring an effective microphone pair and a predetermined straight line is θ, the angles θ of all effective microphone pairs acquired from the plurality of microphone elements 20*a* to 20*d* are varied.

This allows the sound collecting apparatus 10 to supplement the dead angle of one reference signal by another reference signal, thereby suppressing noise in various directions. That is, the sound collecting apparatus 10 can effectively suppress sounds other than the target sound.

Also, for example, the total number of the plurality of microphone elements 20*a* to 20*d* is an even number.

This allows acquirement of an effect of easy compatibility with another hardware.

Furthermore, for example, the total number of the plurality of microphone elements 20*a* to 20*d* is equal to or larger than six.

This allows acquirement of a sufficient noise suppression amount.

Still further, for example, when the total number of effective microphone pairs is n (n is a natural number), all of the effective microphone pairs included in the plurality of microphone elements 20*a* to 20*d* have angles θ varied by 180/n [°].

This reduces directions in which sensitivity is not decreasable in the output signal Y and can suppress noise in various directions.

Still further, for example, in all effective microphone pairs acquired from the plurality of microphone elements 20*a* to 20*d*, angle ranges in which sensitivity in the sensitivity characteristics of the second signal acquired from the effective microphone pair has a value equal to or smaller than a predetermined value do not overlap one another.

This reduces directions in which sensitivity is not decreasable in the output signal Y and can suppress noise in various directions.

Still further, for example, the total number of microphone pairs acquired from the plurality of microphone elements 20*a* to 20*d* is equal to the total number of effective microphone pairs.

Thus, since all microphone pairs function as effective microphone pairs, the sound collecting apparatus 10 can effectively suppress sounds other than the target sound.

Still further, for example, the plurality of microphone elements are arranged at positions corresponding to vertexes of an equilateral N-gon (N is an odd number) and a center position of the equilateral N-gon.

In this manner, if the plurality of microphone elements are arranged so as to form an equilateral N-gon (N is an odd number) surrounding and centering on one microphone element, as depicted in FIG. 10 described above, the evaluation value A calculated based on Equation 2 has a small value. That is, the dead angles of the reference signals are distributed almost equally. Therefore, directions in which sensitivity is not decreasable in the output signal Y are reduced, and the sound collecting apparatus 10 can suppress noise in various directions.

Still further, for example, the sound collecting apparatus 10 further includes: the delay devices 31*a* to 31*d* which give a delay to voice signals acquired from the plurality of microphone elements 20*a* to 20*d*; the main signal generating unit 31 which generates the main signal $X_m$ by adding the output signals from the delay devices 31*a* to 31*d*; the reference signal generating units 32*a* to 32*f* which generate the reference signals $X_{r1}$ to $X_{r6}$ by performing subtraction on output signals corresponding to two microphone elements configuring an effective microphone pair among output signals from the delay devices 31*a* to 31*d*; the adaptive filter units 33*a* to 33*f* which apply filter coefficients to the reference signals $X_{r1}$ to $X_{r6}$; the subtracting unit 34 which subtracts the reference signals $X_{r1}$ to $X_{r6}$ applied with the filter coefficients from the generated main signal $X_m$; and the coefficient updating unit 35 which updates the filter coefficients based on the output signal Y acquired by subtraction of the subtracting unit 34.

The delay devices 31*a* to 31*d* are one example of delay devices. The main signal $X_m$ is one example of the first signal, and is a signal acquired by adding voice signals given, by the delay devices 31*a* to 31*d*, the delay in accordance with the target sound direction (output signals from the delay devices 31*a* to 31*d*) to voice signals acquired from the plurality of respective microphone elements 20*a* to 20*d*. The reference signals $X_{r1}$ to $X_{r6}$ are one example of the second signal, and is a signal acquired by performing subtraction on voice signals acquired from two microphone elements configuring an effective microphone pair and given, by the delay devices 31*a* to 31*d*, the delay in accordance with the target sound direction (output signals from the delay devices 31*a* to 31*d*). The main signal generating unit 31 is one example of the first signal generating unit, each of the reference signal generating units 32*a* to 32*f* is one example of the second signal generating unit, and the output signal Y is an example of the third signal.

This allows the sound collecting apparatus 10 to perform beamforming based on the voice signals acquired from the plurality of microphone elements 20*a* to 20*d*.

(Other Embodiments)

While the present embodiment has been described, the present disclosure is not limited to this embodiment.

For example, the shape and others of the sound collecting apparatus described in the above embodiment is merely one example, and the sound collecting apparatus may have another shape such as a rectangular parallelepiped shape.

The configuration of the signal processing unit according to the above embodiment is merely one example. The signal processing unit may include a component such as, for example, a D/A converter, a low-pass filter (LPF), a high-pass filter (HPF), a power amplifier, or an A/D converter. Also, signal processing to be performed by the signal processing unit is, for example, digital processing, but may be partially analog signal processing.

Also in the above embodiment, the signal processing unit may be achieved by being configured of dedicated hardware or by executing a software program suitable for the signal processing unit. The signal processing unit may be achieved by a program executing unit such as a CPU or processor reading and executing a software program recorded on a recording medium such as a hard disk or semiconductor memory.

Also, the signal processing unit may be a circuit (or an integrated circuit). These circuits may configure one circuit as a whole, or may be separate circuits. Also, these circuits may be general-purpose circuits or dedicated circuits.

Other forms acquired from various modifications conceived by people skilled in the art on the above embodiment and achieved by combining any of the components and functions described in the above embodiment in a range not deviating from the gist of the present disclosure are also included in the present disclosure.

For example, the present disclosure may be achieved as a system including the sound collecting apparatus of the above embodiment. Also, the present disclosure may be an evaluation method to be executed by a computer as a method of evaluating the arrangement of a plurality of microphone elements based on the above Equations 2 to 4.

The sound collecting apparatus of the present disclosure is useful as a sound collecting apparatus for use in a telephone conference system or the like.

What is claimed is:

1. A sound collecting apparatus, comprising:

a plurality of microphones, wherein among a plurality of microphone pairs, each microphone pair configured of any two microphones included in the plurality of microphones, a total number of a plurality of effective microphone pairs, in which a distance between the two microphones is smaller than a distance D, is larger than a total number of the plurality of microphones, the distance D is represented by D=c/2f, where a frequency of a target sound acquired from the plurality of microphones is f and sound velocity is c, and when an angle formed by a straight line connecting two microphones configuring each of the plurality of effective microphone pairs and a predetermined straight line is θ, the angles θ of all of the plurality of effective microphone pairs acquired from the plurality of microphones are different from each other.

2. The sound collecting apparatus according to claim 1, wherein the total number of the plurality of microphones is an even number.

3. The sound collecting apparatus according to claim 1, wherein the total number of the plurality of microphones is equal to or larger than six.

4. The sound collecting apparatus according to claim 1, wherein sensitivity characteristics of a plurality of signals acquired from all of the plurality of effective microphone pairs acquired from the plurality of microphones do not overlap in an angle range equal to or smaller than a predetermined value.

5. The sound collecting apparatus according to claim 1, wherein the plurality of microphones are arranged at positions corresponding to vertexes of an equilateral N-gon, N being an odd number greater than one, and a center position of the equilateral N-gon.

6. The sound collecting apparatus according to claim 1, further comprising:

a processor; and a non-transitory recording medium storing thereon a computer program, which when executed by the processor, causes the processor to perform operations including giving a delay to a voice signal acquired from each of the plurality of microphones to generate delayed output signals, generating a first signal by adding the delayed output signals, generating a second signal by performing subtraction on output signals corresponding to two microphones configuring the effective microphone pair among the delayed output signals, applying a filter coefficient to the second signal, generating a third signal by subtracting the second signal applied with the filter coefficient from the generated first signal, and updating the filter coefficient based on the third signal.

* * * * *